US008249494B2

(12) United States Patent
Ishikuro

(10) Patent No.: US 8,249,494 B2
(45) Date of Patent: Aug. 21, 2012

(54) IMAGE FORMING APPARATUS

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 285 days.

(21) Appl. No.: 11/460,259

(22) Filed: Jul. 27, 2006

(65) Prior Publication Data

US 2007/0048055 A1 Mar. 1, 2007

(30) Foreign Application Priority Data

Aug. 23, 2005 (JP) ..... 2005-241209

(51) Int. Cl.
*G03G 15/00* (2006.01)

(52) U.S. Cl. ..... 399/405; 271/65; 271/184; 271/185; 271/186; 271/303

(58) Field of Classification Search ..... 399/405; 271/65, 184, 185, 186, 303
See application file for complete search history.

(56) References Cited

U.S. PATENT DOCUMENTS

| | | | | |
|---|---|---|---|---|
| 5,234,213 | A * | 8/1993 | Chen | 271/303 |
| 5,586,758 | A * | 12/1996 | Kimura et al. | 271/303 |
| 2004/0018034 | A1 * | 1/2004 | Baek et al. | 399/405 |

FOREIGN PATENT DOCUMENTS

| | | | |
|---|---|---|---|
| JP | 3256968 | A | 11/1991 |
| JP | 5024732 | A | 2/1993 |
| JP | 11130311 | A | 5/1999 |
| JP | 2000-267544 | A | 9/2000 |
| JP | 2004352413 | A | 12/2004 |

* cited by examiner

*Primary Examiner* — Judy Nguyen
*Assistant Examiner* — Andy Pham
(74) *Attorney, Agent, or Firm* — Panitch Schwarze Belisario & Nadel LLP

(57) ABSTRACT

An image forming apparatus capable of properly discharging a medium has a first medium stacking unit, a second medium stacking unit, and a guiding member for guiding the medium to the second medium stacking unit in a case that the second medium stacking unit is set in an opened state and guiding the medium to the first medium stacking unit in a case that the second medium stacking unit is set in a closed state. Since the guiding member guides the medium to the second medium stacking unit in a case that the second medium stacking unit is set in the opened state and guides medium to the first medium stacking unit in a case that the second medium stacking unit is set in the closed state, the medium can be discharged to the second medium stacking unit in a case that large normal curling occurs.

17 Claims, 16 Drawing Sheets

IMAGE FORMING APPARATUS

BACKGROUND OF THE INVENTION

This invention relates to an image forming apparatus.

Conventionally, an imaging forming apparatus such as, e.g., a printer, a photocopier, a facsimile machine, and a multi-functional machine, for example, an electrophotographic printer includes a paper feed mechanism for feeding paper as a medium, an image forming unit for forming a toner image, a fuser for fusing the toner image, a discharging mechanism for discharging the paper, and the like. The discharging mechanism is composed of a face down discharging unit composing a first discharging unit to which printed paper is discharged with a printed side down, and a face up discharging unit composing a second discharging unit capable of discharging various sorts of paper, performing post processing such as, e.g., sorting operation and punching operation and discharging the paper with the printed side up. The paper can be selectively discharged to either the face down discharging unit or the face up discharging unit, by an operator's switching a discharging route. (see, e.g., Japanese Unexamined Patent Publication No. 2000-267544)

With such a conventional electrophotographic printer, however, such paper as moved through the fuser gets curled, i.e., deformed, in a crescent shape, not only because the paper receives heat from a printing side at the time when a toner image is fused but also because a toner is fused on the printing side. There are two types of curling, normal curling, i.e., a concave curling, and reverse curling. For example, in a case of occurrence of large normal curling, even where paper is to be discharged to the face up discharging unit, the paper with large normal curling undesirably goes into the face down discharging unit. As the result, paper jamming occurs, and the paper cannot be discharged properly.

BRIEF SUMMARY OF THE INVENTION

It is an object of this invention to solve the problems in conventional printers described above and further to provide an image forming apparatus capable of properly discharging the medium.

To achieve the above, an image forming apparatus according to this invention has a first medium stacking unit for stacking the medium, a second medium stacking unit capable of being opened and closed with respect to an apparatus body for stacking the medium, and a guiding member arranged swingably on the apparatus body for leading the medium to the second medium stacking unit in a case that the second medium stacking unit is in an opened state and for leading the medium to the first medium stacking unit in a case that the second medium stacking unit is in a closed state.

According to this invention, an image forming apparatus has the first medium stacking unit for stacking the medium, the second medium stacking unit capable of being opened and closed with respect to the apparatus body for stacking the medium, and the guiding member arranged swingably on the apparatus body for leading the medium to the second medium stacking unit in a case that the second medium stacking unit is in the opened state and for leading the medium to the first medium stacking unit in a case that the second medium stacking unit is in the closed state.

In the above case, since the guiding member arranged swingably on the apparatus body leads the medium to the second medium stacking unit in a case that the second medium stacking unit is in the opened state and leads the medium to the first medium stacking unit in a case that the second medium stacking unit is in the closed state, for example, in a case that large normal curling occurs with the medium, the medium can be discharged to the second medium stacking unit without rendering the medium into a face down conveyance route. Consequently, no paper jamming occurs, and the medium can be discharged properly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Hereinafter, embodiments according to this invention will be described with reference to the figures. In this case, an image forming apparatus such as, e.g., an electrophotographic color printer will be described.

Figure 2:
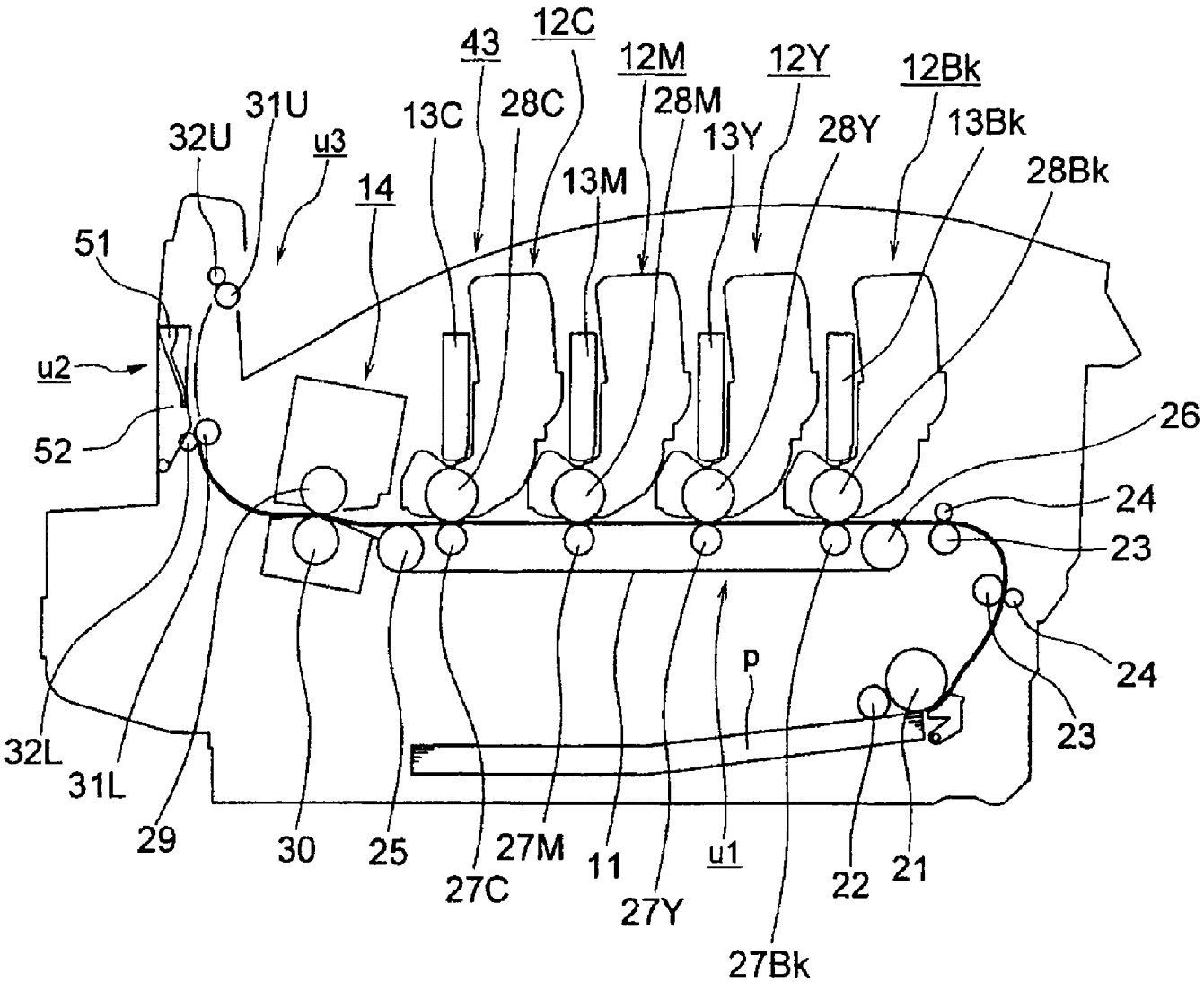
FIG. 2 is a schematic view showing a printer according to the first embodiment of this invention.

FIG. 2 is a schematic view showing a printer according to the first embodiment of this invention.

In the figure, P is paper as a medium, and an anterior end of the paper P is pushed up by a sheet receiver, not shown, in a paper feeding cassette, not shown, serving as a medium containing unit so that the paper P is appressed to a paper feeding roller 21. By driving a conveyance motor, not shown, the paper feeding roller 21 and a paper feeding sub roller 22 are rotated, and thus the paper P is fed successively from the paper feeding cassette to a conveyance route. On the conveyance route, a resister roller 23 is arranged on a downstream side relative to the paper feeding roller 21 in a conveyance direction of paper P; a pressure roller 24 is arranged opposing the resister roller 23; and the paper P is conveyed as sandwiched between the resister roller 23 and the pressure roller 24.

A conveyance belt unit u1 has a driving roller 25 driven by a belt motor, not shown, an idle roller 26, and an endless conveyance belt 11 arranged to be tensioned between the driving roller 25 and the idle roller 26 and serving as a conveyance member driven to convey the paper P. The idle roller 26 rotates in association with a movement of the conveyance belt 11 and gives tension so that the conveyance belt 11 does not come loose.

On the conveyance belt 11, ID units 12Bk, 12Y, 12M, and 12C as image forming units are arranged side by side along the conveyance direction of the paper P. At an inside of the discharging belt 11, transfer rollers 27Bk, 27Y, 27M, and 27C as transfer members giving transfer voltage are arranged respectively opposing ID units 12Bk, 12Y, 12M, and 12C.

The ID units 12Bk, 12Y, 12M, and 12C have not only photosensitive drums 28Bk, 28Y, 28M, and 28C respectively as image carriers but also charging rollers as charging devices for evenly and uniformly charging surfaces of the photosensitive drums 28Bk, 28Y, 28M, and 28C, developing units for developing images by attaching black, yellow, magenta, and cyan toners respectively as developers onto electrostatic latent images formed on the surfaces of photosensitive drums 28Bk, 28Y, 28M, and 28C, to form toner images as developer images, and cleaning blades as cleaning devices to remove toners remaining on the surfaces of the photosensitive drums 28Bk, 28Y, 28M, and 28C.

LED heads 13Bk, 13Y, 13M, and 13C as exposure devices are respectively arranged adjacent to the ID units 12Bk, 12Y, 12M and 12C and opposing the photosensitive drums 28Bk, 28Y, 28M, and 28C. The LED heads 13Bk, 13Y, 13M, and 13C irradiate the surfaces of the photosensitive drums 28Bk, 28Y, 28M, and 28C by driving LEDs, thereby forming electrostatic latent images. Furthermore, each of the transfer rollers 27Bk, 27Y, 27M, and 27C successively transfers the toner image of each color onto the paper P conveyed by the conveyance belt 11 to form a color toner image.

A fuser 14 serving as a fusing device has a fusing roller 29 rotated by a fusing motor, not shown, and a pressure roller 30 rotating in association with a movement of the fusing roller 29. The fuser 14 forms a color image by fusing the color toner image on the paper P conveyed by the conveyance belt 11.

The paper P on which the color image was formed is conveyed by a discharging roller 31L driven by the fusing motor and by a discharging roller 32L rotating in association with the discharging roller 31L. The paper P is discharged either to a face up stacker 52 via a leading guides 51 serving as guiding members or to a top cover 43 upon being conveyed by the discharging rollers 31L and 32L and further conveyed by a discharging roller 31U driven by the fusing motor and by a discharging roller 32U rotating in association with the discharging roller 31U. It is to be noted that the first medium stacking unit is composed of the top cover 43 and the second medium stacking unit is formed with the face up stacker 52.

A face up discharging unit u2 is composed of the discharging roller 31L, the discharging roller 32L, the leading guides 51, the face up stacker 52, and the like. A face down discharging unit u3 is composed of the discharging roller 31U, the discharging roller 32U, the top cover 43, and the like. Furthermore, a discharging member is composed of the discharging rollers 31L, 31U and the discharging rollers 32L, 32U.

Figure 1:
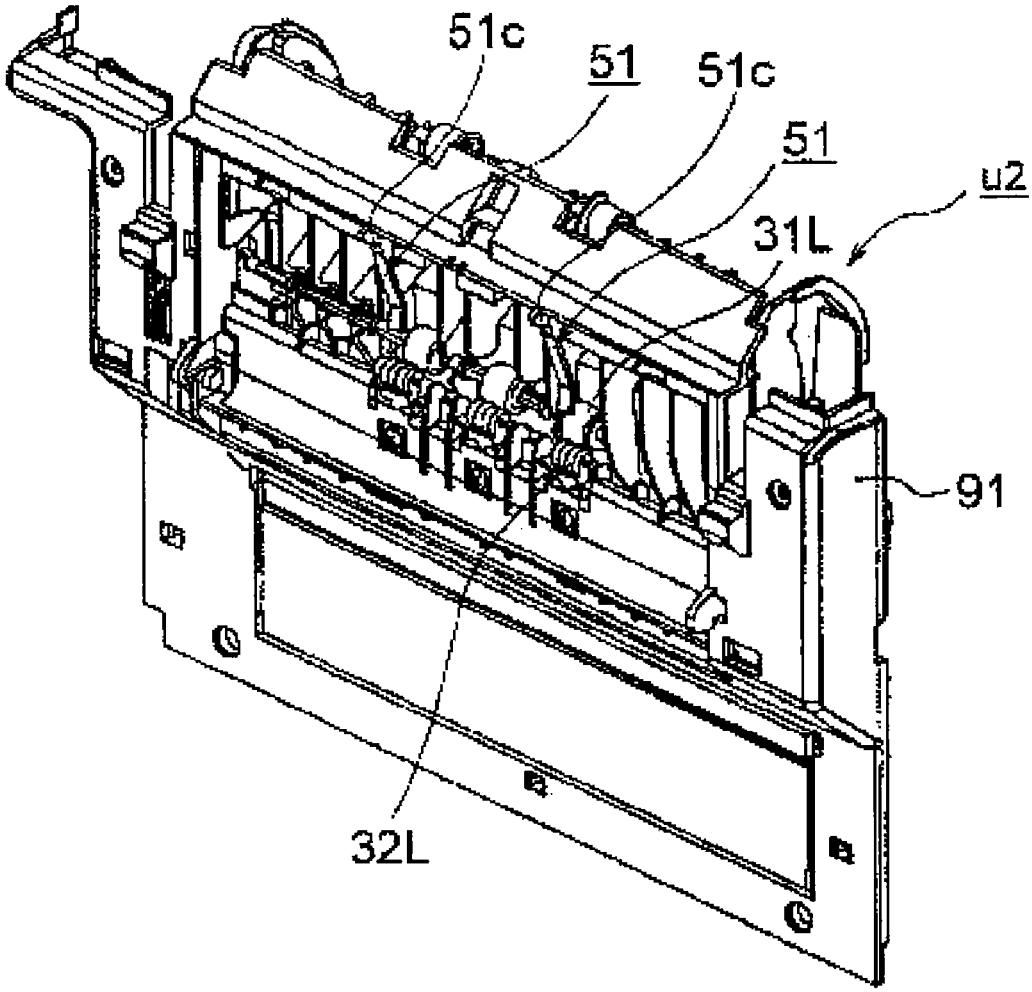
FIG. 1 is a perspective view showing an essential portion of a face up discharging unit according to the first embodiment of this invention.
Figure 3:
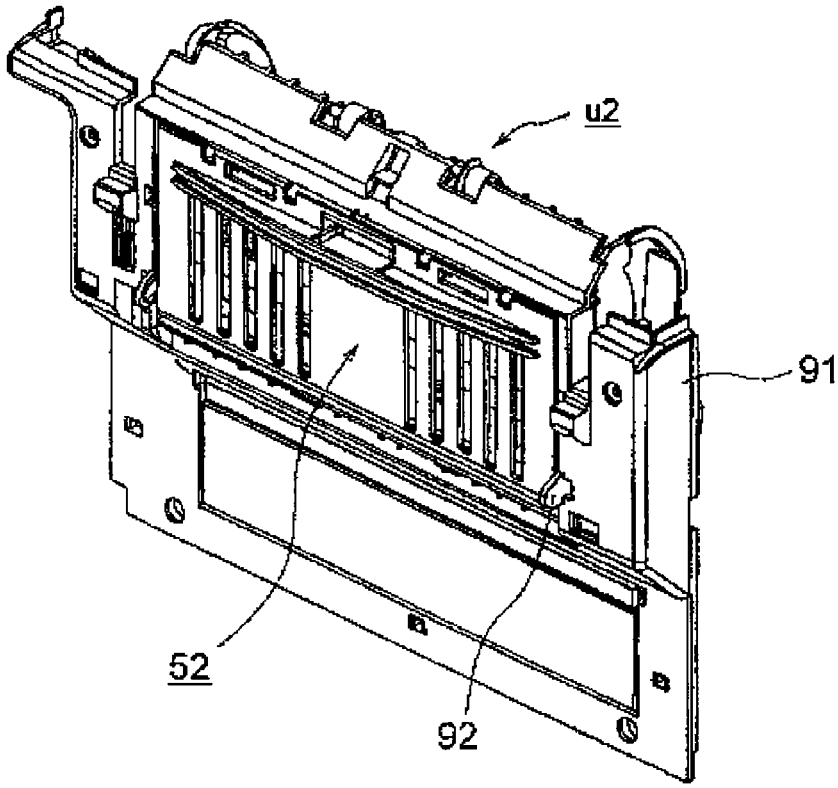
FIG. 3 is a perspective view showing the face up discharging unit according to the first embodiment of this invention.

FIG. 1 is a perspective view showing an essential portion of the face up discharging unit according to the first embodiment of this invention. FIG. 3 is a perspective view showing the face up discharging unit according to the first embodiment of this invention.

In the figure, numeral u2 is the face up discharging unit; numeral 91 is the apparatus body of the printer; numerals 51 are a plurality of leading guides (i.e., a pair of leading guides in this embodiment) arranged swingably with respect to the apparatus body 91 about a rotation center 51*c*, the rotation center 51*c* being formed at an upper end thereof; numeral 52 is the face up stacker arranged pivotally about a swinging supporting portion 92 formed at a lower end thereof and capable of taking either an opened position and a closed position; numeral 31L is the discharging roller; numeral 32L is the discharging roller; and FIG. 1 shows a state where the face up stacker 52 is removed. A space between the leading guides 51 is rendered narrower than a minimum width of the paper P. Although a pair of the leading guides 51 are arranged in this embodiment, for example, in a case that three or more pieces of the leading guides are arranged, at least one of the spaces among the leading guides is rendered narrower than a minimum width of the paper P.

When the paper P is conveyed to the face down discharging unit u3 (FIG. 2), the leading guides 51 have a function of conveyance guides and are held by the face up stacker 52. Furthermore, the face up stacker 52 can be opened and closed. The face up stacker 52 has a function of the conveyance guide in the closed position when the paper P is to be discharged to the face down discharging unit u3 (hereinafter referred to as "at the time of the face down printing") while having a function of a stacking unit for allowing the discharged paper P stacked thereon in the opened position when the paper P is to be discharged to the face up discharging unit u2 (hereinafter referred to as "at the time of the face up printing"). Each of the leading guides 51 is arranged at an interval narrower than a paper width as a medium width printable in a horizontal direction.

Figure 4:
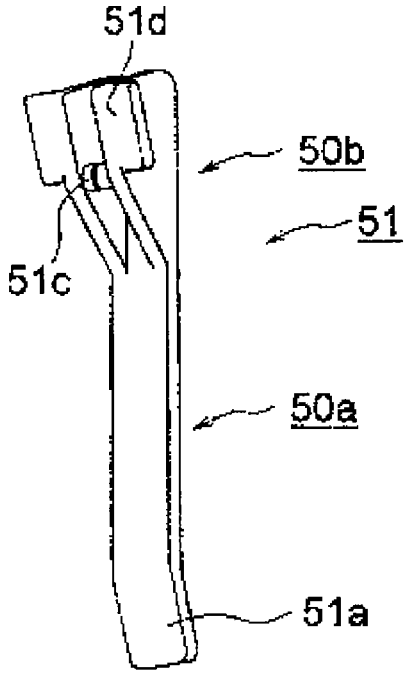
FIG. 4 is a perspective view showing a leading guide according to the first embodiment of this invention.
Figure 5:
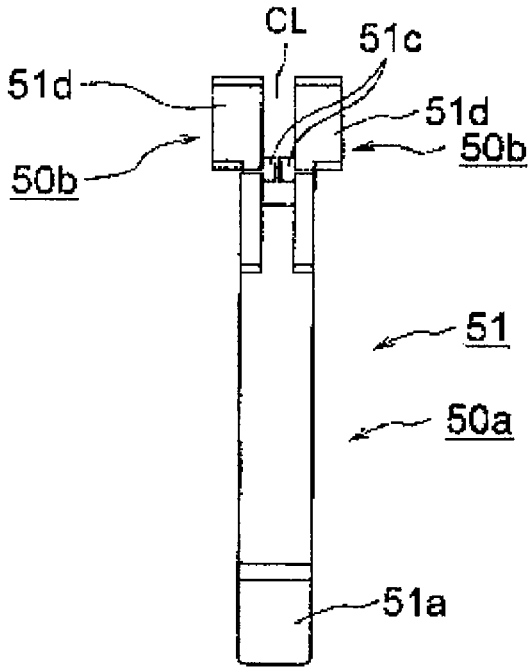
FIG. 5 is a front view showing the leading guide according to the first embodiment of this invention.
Figure 6:
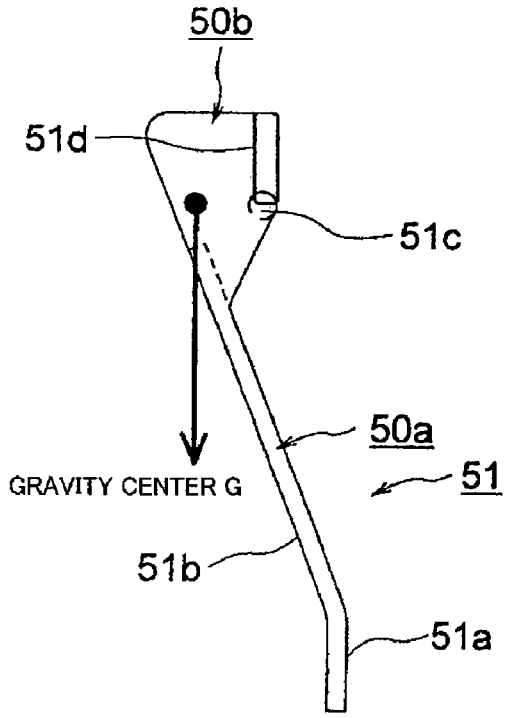
FIG. 6 is a diagram showing a relationship between a gravity center and a rotation center of the leading guide according to the first embodiment of this invention.

FIG. 4 is a perspective view showing the leading guide according to the first embodiment of this invention; FIG. 5 is a front view of the leading guide according to the first embodiment of this invention; and FIG. 6 is a diagram showing a relationship between a gravity center and a rotation center of the leading guide according to the first embodiment of this invention.

As shown in the figures, the leading guide 51 has a tabular guiding portion 50*a* in a bent shape, the guiding portion 50*a* being bent at a point near lower end, and a pair of attaching portions 50*b* in a triangular shape, the attaching portions 50*b* being formed at an upper end of the guiding portion 50*a* with a prescribed clearance CL therebetween. First and second surfaces 51*a* and 51*b* are formed on the guiding portion 51*a* in order to guide the paper P (FIG. 2). Furthermore, the attaching portions 50*b* respectively have rotation centers 51*c* formed opposing each other toward the clearance CL and stopper portions 51*d* formed projecting in a direction opposite to the clearance CL. A gravity center G of the leading guide 51 is set at a side of the face up stacker 52 with respect to the rotation center 51*c* on the attaching portions 50*b*.

Figure 7:
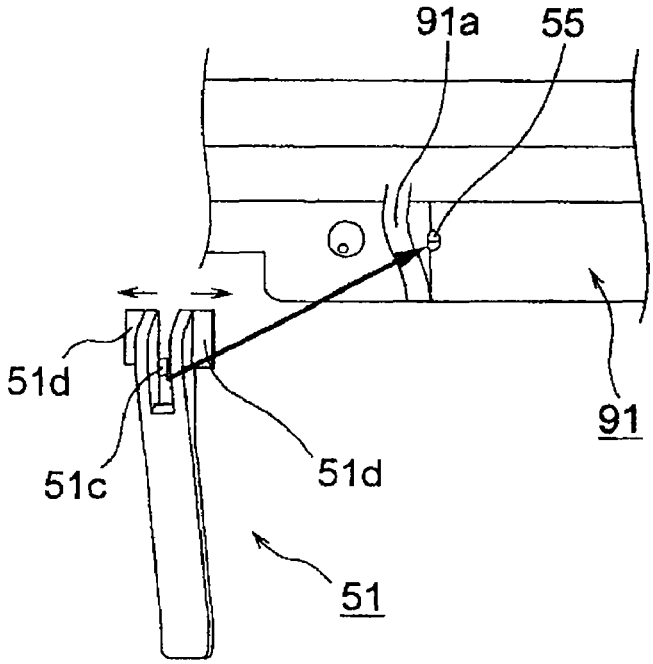
FIG. 7 is a diagram showing a method of mounting the leading guide according to the first embodiment of this invention.
Figure 8:
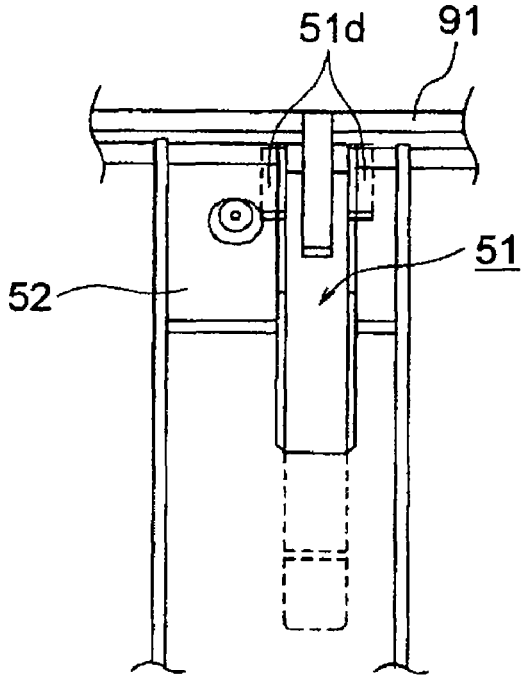
FIG. 8 is a diagram showing a relationship between the leading guide and a face up stacker at the time of a face down printing according to the first embodiment of this invention.

FIG. 7 is a diagram showing a method of attaching the leading guide according to the first embodiment of this invention, and FIG. 8 is a diagram showing a relationship between the leading guide and the face up stacker at the time of the face down printing according to the first embodiment of this invention.

As shown in the figures, a clearance between the rotation centers 51*c* is widened by pulling the both sides of the stopper portions 51*d* in directions indicated respectively by arrows, and then the rotation centers 51*c* are engaged in holes 55 previously formed on a back side of the apparatus body 91 with the stopper portions 51*d* replaced to the original positions, so that the leading guide 51 can be attached to the apparatus body 91. On the apparatus body 91, a bracket 91*a* in a triangular shape is formed as protruding, and the leading guide 51 is attached in a manner to sandwich the bracket 91*a* between the attaching portions 50*b* (FIG. 6). Numeral 52 is the face up stacker.

Figure 9:
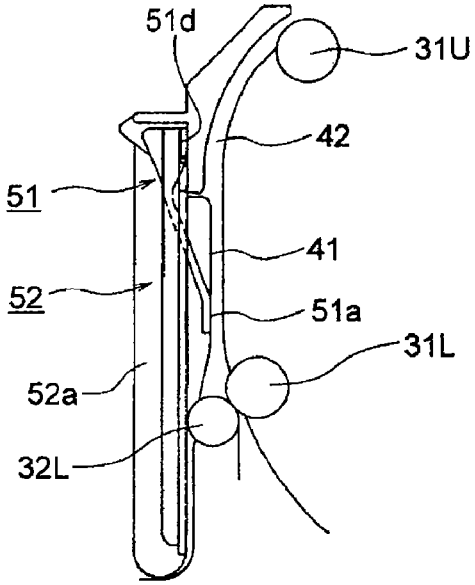
FIG. 9 is a diagram showing the face up discharging unit at the time of the face down printing according to the first embodiment of this invention.
Figure 10:
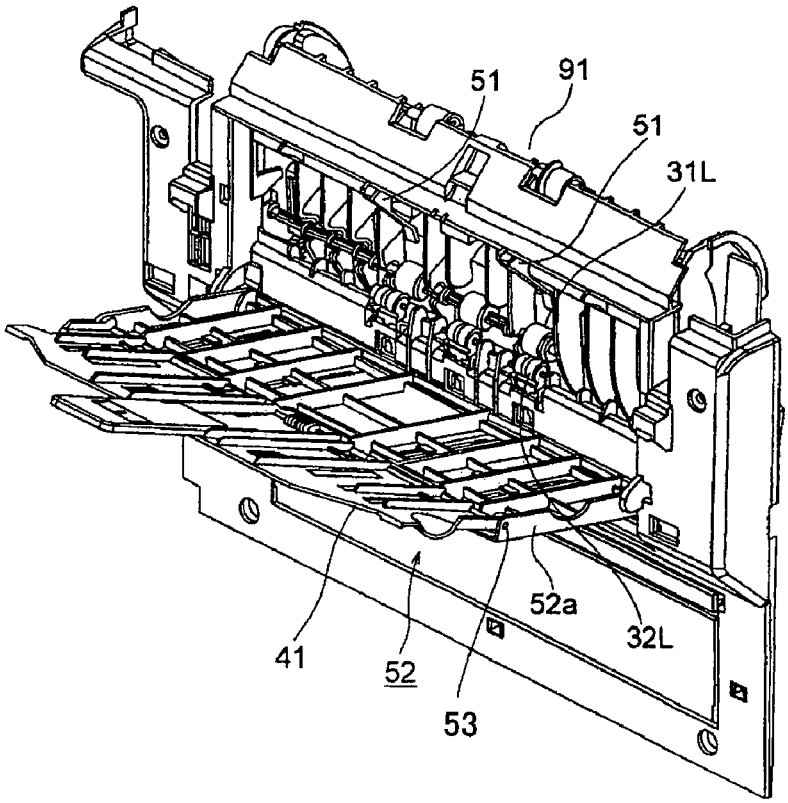
FIG. 10 is a perspective view showing the face up discharging unit at the time of a face up printing according to the first embodiment of this invention.

FIG. 9 is a diagram showing the face up discharging unit at the time of the face down printing according to the first embodiment of this invention; FIG. 10 is a perspective view showing the face up discharging unit at the time of the face up printing according to the first embodiment of this invention; and FIG. 11 is a conceptual view showing the face up discharging unit at the time of the face up printing according to the first embodiment of this invention.

At the time of the face down printing, as shown in FIG. 9, when the face up stacker 52 is set in the closed position, the stopper portions 51*d* are sandwiched between the face up stacker 52 and the apparatus body 91 so that the leading guide 51 is held in a non-swingable state. The face up stacker 52 is arranged swingably about the swinging supporting portion 92 with respect to the apparatus body 91. The face up stacker 52 has a main body 52*a* and a guiding portion 41 connected to the main body 52*a* via a hinge 53. The guiding portion 41 is folded in when the face up stacker 52 is set in the closed position. As shown in FIG. 11, a rib formed on a surface opposite to a medium stacking surface of the guiding portion 41 assists in conveying the medium to the guiding portion 41.

The paper P conveyed by the discharging roller 31L and by the discharging roller 32L is guided to a face down conveyance route 42 by the guiding portion 41 of the face up stacker 52 and by a first surface 51*a* of the leading guide 51. Furthermore, the paper P is conveyed by a discharging roller 31U and a discharging roller 32U.

Figure 11:
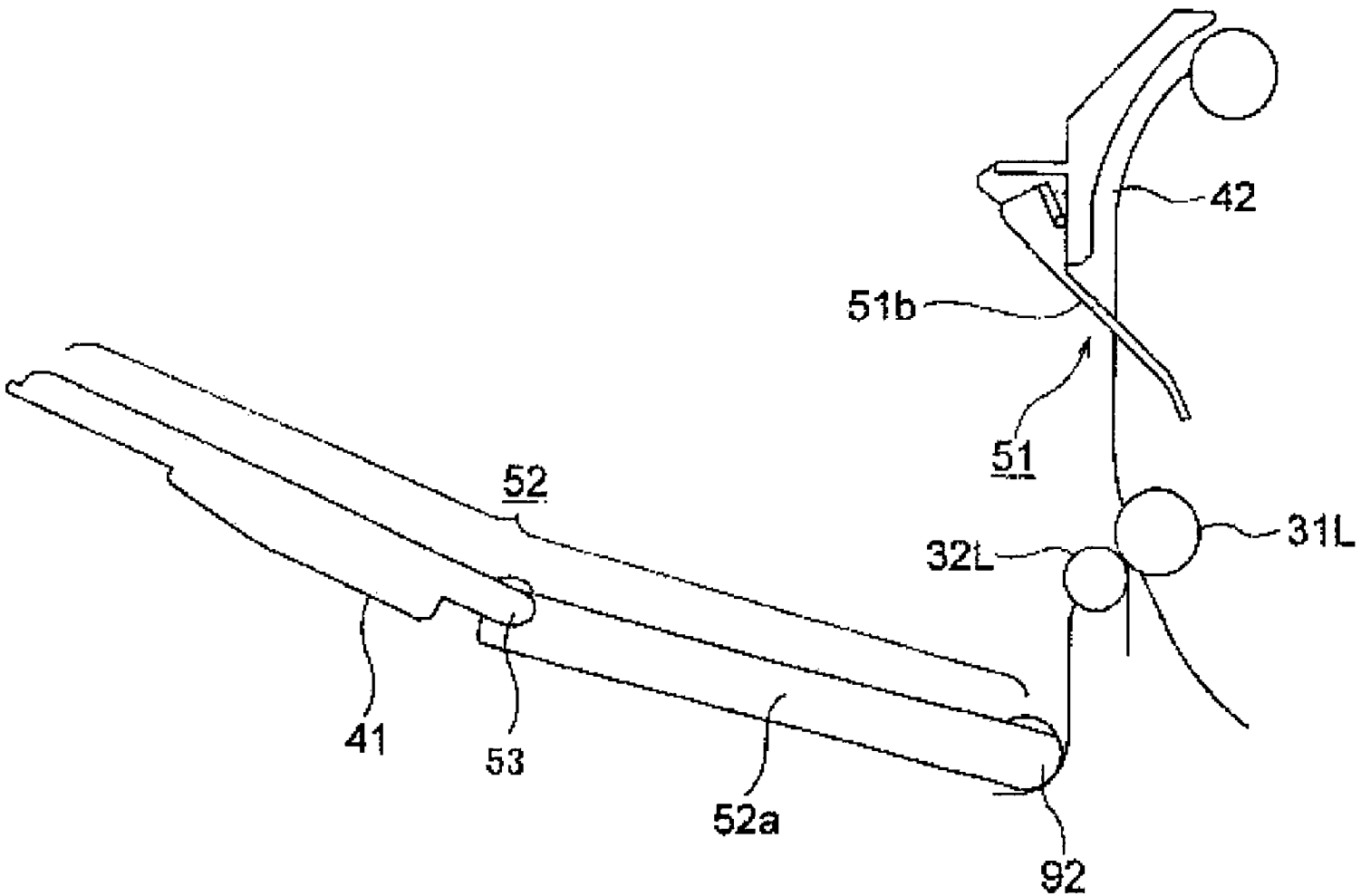
FIG. 11 is a conceptual view showing the face up discharging unit at the time of the face up printing according to the first embodiment of this invention.

At the time of the face up printing, as shown in FIGS. 10 and 11, when the face up stacker 52 is set in the opened position, each of the leading guides 51 is rotated by its own weight, thereby being rendered in a position across the face down conveyance route 42, and thus a second surface 51*b* forms a face up conveyance route.

The paper P conveyed by the discharging roller 31L and by the discharging roller 32L is discharged to the face up stacker 52 along the second surface 51*b* of the leading guides 51 without entering into the face down conveyance route 42.

Therefore, according to the embodiment, for example, in a case that large normal curing occurs on the paper P, the paper P can be discharged to the face up stacker 52 without entering into the face down conveyance route 42. Consequently, no paper jamming occurs, and the paper P is discharged properly.

Since the leading guide 51 returns the paper P with normal curling to its original shape and gives elasticity thereto, the paper P can be stacked on the face up stacker 52 in a good condition.

In the meantime, in a case that reverse curling of the paper P occurs, the paper P is discharged without coming in contact with the leading guide 51, and thus the reverse curling is not promoted.

Since the leading guide 51 can be rotated by its own weight, an urging member and the like are not required. Thus, a cost for the printer is reduced.

Although the leading guides 51 automatically rotates when the face up stacker 52 is either opened or closed according to the embodiment of this invention, the leading guides 51 can also be manually rotated by an operator. Although the leading guides 51 are arranged at the two locations according to the embodiment of this invention, the leading guide 51 can be arranged at one location in the center.

In the meantime, according to the embodiment of this invention, in a case that elastic paper P such as, e.g., thick paper and a postcard is used, the leading guide 51 cannot be surely arranged at a location across the face down conveyance route 42. In a case that the rotation centers 51*c* become bumpy, the leading guides 51 cannot be switched stably over a protracted period of time.

Hereinafter the second embodiment will be described. It is to be noted that the substantially same structures as those of the first embodiment are assigned with the same reference numbers respectively so that those duplicated descriptions are omitted, and the advantageous effect of the first embodiment is applied to the advantageous effects of the second embodiment produced because of the substantially same structures as those of the first embodiment. Since a structure of a printer according to the second embodiment of this invention is the same as that according to the first embodiment of this invention, it will be described with reference to FIG. 2.

Figure 12:
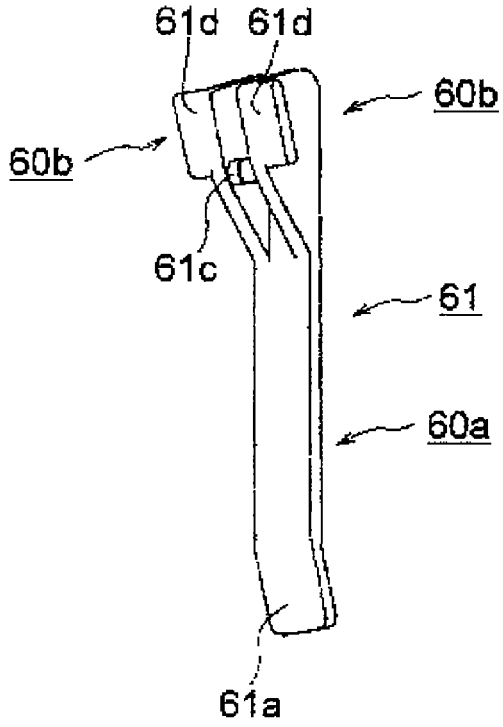
FIG. 12 is a perspective view showing the leading guide according to the second embodiment of this invention.
Figure 13:
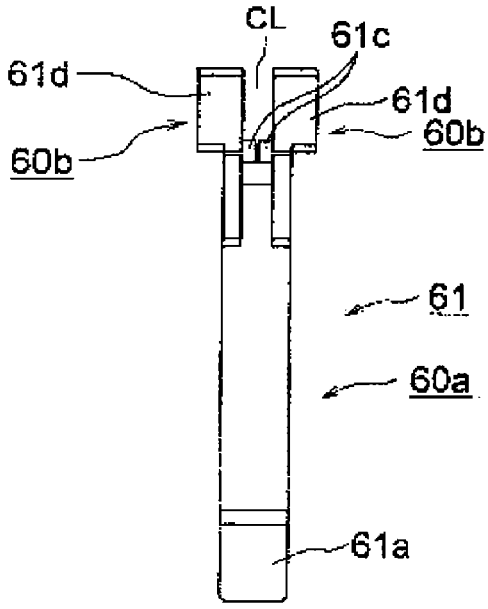
FIG. 13 is a front view showing the leading guide according to the second embodiment of this invention.
Figure 14:
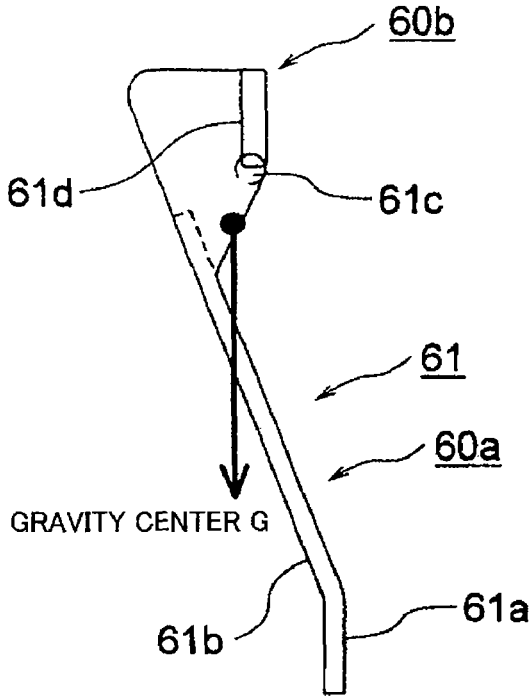
FIG. 14 is a diagram showing a relationship between the gravity center and the rotation center of the leading guide according to the second embodiment of this invention.
Figure 15:
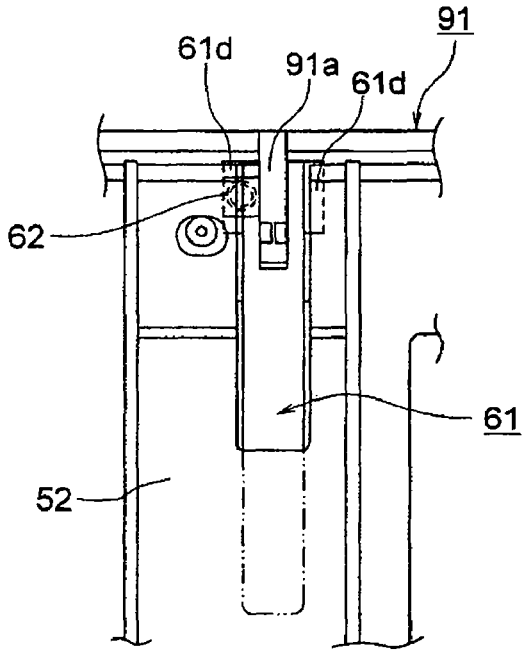
FIG. 15 is a diagram showing a relationship between the leading guide and the face up stacker at the time of the face down printing according to the second embodiment of this invention.

FIG. 12 is a perspective view showing the leading guide according to the second embodiment of this invention; FIG. 13 is a front view showing the leading guide according to the second embodiment of this invention; FIG. 14 is a diagram showing a relationship between the gravity center and the rotation center of the leading guide according to the second embodiment of this invention; FIG. 15 is a diagram showing a relationship between the leading guide and the face up stacker at the time of the face down printing according to the second embodiment of this invention.

As shown in the figure, a leading guide 61 serving as a leading member has a tabular guiding portion 60*a* in a bent shape, the leading member 61 being bent at a point near lower end, and a pair of attaching portions 60*b* in a triangular shape, the attaching portions 60*b* being formed at an upper end of thereof with a prescribed clearance CL therebetween. First and second surfaces 61*a* and 61*b* are formed on the guiding portions 60*a* in order to guide the paper P (FIG. 2) as the medium. The attaching portions 60*b* respectively have rotation centers 61*c* formed opposing one another toward the clearance CL and stopper portions 61*d* formed projecting to a direction opposite to the clearance CL. A gravity center G of the leading guide 61 is set at a side opposite to the face up stacker 52 with respect to a rotation center 61*c* on the attaching portions 60*b*.

In a similar fashion to the first embodiment of this invention, a clearance between the rotation centers 61*c* is widened by pulling respectively the both sides of the rotation centers 61*d*, and then the rotations centers 61*c* are engaged in holes 55 (FIG. 7) previously formed on a back side of the apparatus body 91 with the stopping portions 61*d* replaced to the original positions, so that the leading guide 61 can be attached to the apparatus body 91. On the apparatus body 91, a bracket 91*a* in a triangular shape is formed as protruding, and the leading guide 61 is attached in a manner to sandwich the bracket 91*a* between the attaching portions 60*b*.

A coil spring 62 as an urging member is arranged between one of the attaching portions 60*b* and the apparatus body 91. The coil spring 62 urges the leading guide 61 in a direction of the face up stacker 52. In a case that the face up stacker 52 is set in the closed state, an amount of compression of the coil spring 62 is larger than that in a case that the face up stacker is set in the opened state.

Figure 16:
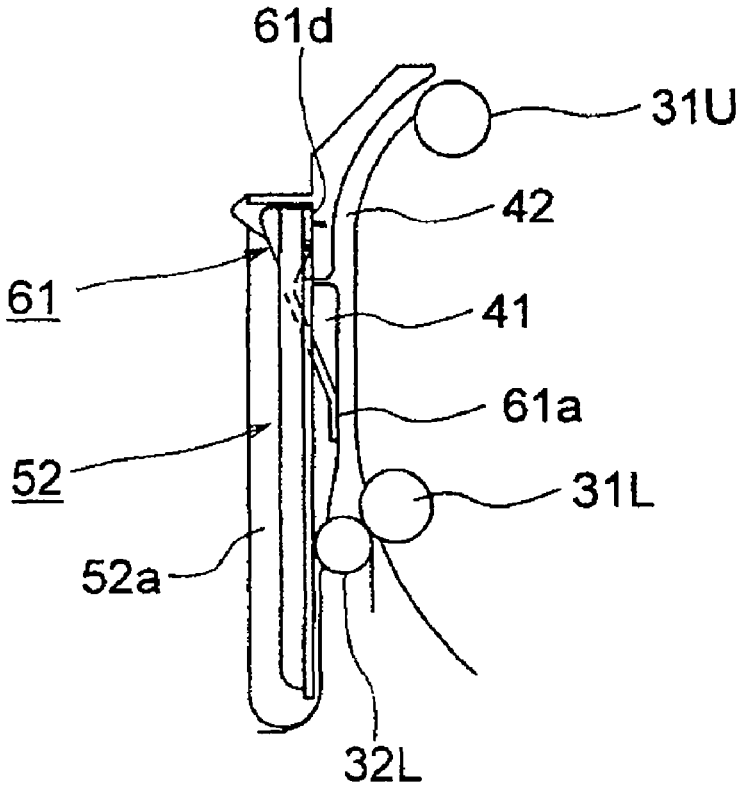
FIG. 16 is a diagram showing the face up discharging unit at the time of the face down printing according to the second embodiment of this invention.
Figure 17:
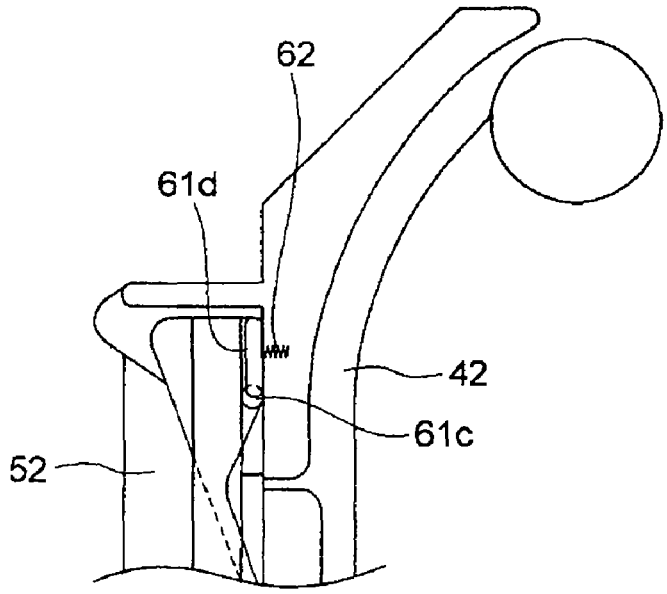
FIG. 17 is a diagram showing an essential portion of the face up discharging unit at the time of the face down printing according to the second embodiment of this invention.
Figure 18:
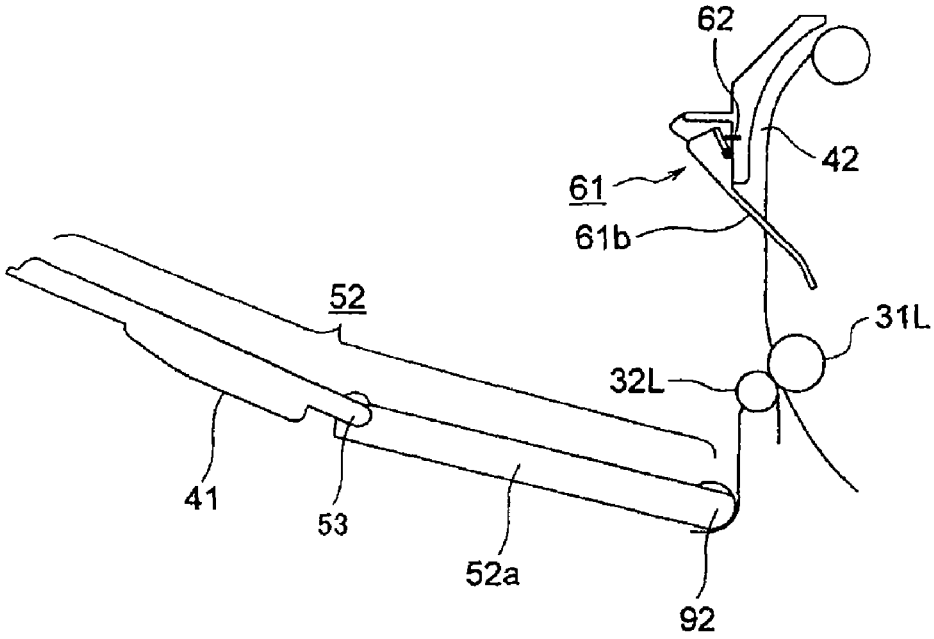
FIG. 18 is a conceptual view showing the face up discharging unit at the time of the face up printing according to the second embodiment of this invention.

FIG. 16 is a diagram showing the face up discharging unit at the time of the face down printing according to the second embodiment of this invention; FIG. 17 is a drawing showing an essential portion of the face up discharging unit at the time of the face down printing according to the second embodiment of this invention; FIG. 18 is a conceptual view of the face up discharging unit at the time of the face up printing according to the second embodiment of this invention; and FIG. 19 is a conceptual view showing an essential portion of the face up discharging unit at the time of the face up printing according to the second embodiment of this invention.

At the time of the face down printing, as shown in FIGS. 16 and 17, when the face up stacker 52 is set in the closed position, the stopper portions 61*d*, opposing the urging force of the coil spring 62, is sandwiched between the face up stacker 52 and the apparatus body 91 (FIG. 15), and thereby the leading guide 61 is held in a non-swingable state. It is to be noted that the face up stacker 52 is arranged pivotally about the swinging supporting portion 92 relative to the apparatus body 91, and the face up stacker 52 has the main body 52*a* and the guiding portion 41 connected to the main body 52*a* via the hinge 53. The guiding portion 41 is folded in when the face up stacker 52 is set in the closed position.

The paper P (FIG. 2) is conveyed by the discharging roller 31L and by the discharging roller 32L, and the paper P is guided to the face down conveyance route 42 by the guiding portion 41 of the face up stacker 52 and by the first surface 61*a* of the leading guide 61. Furthermore, the paper P is conveyed by the discharging roller 31U and by the discharging roller 32U.

Figure 19:
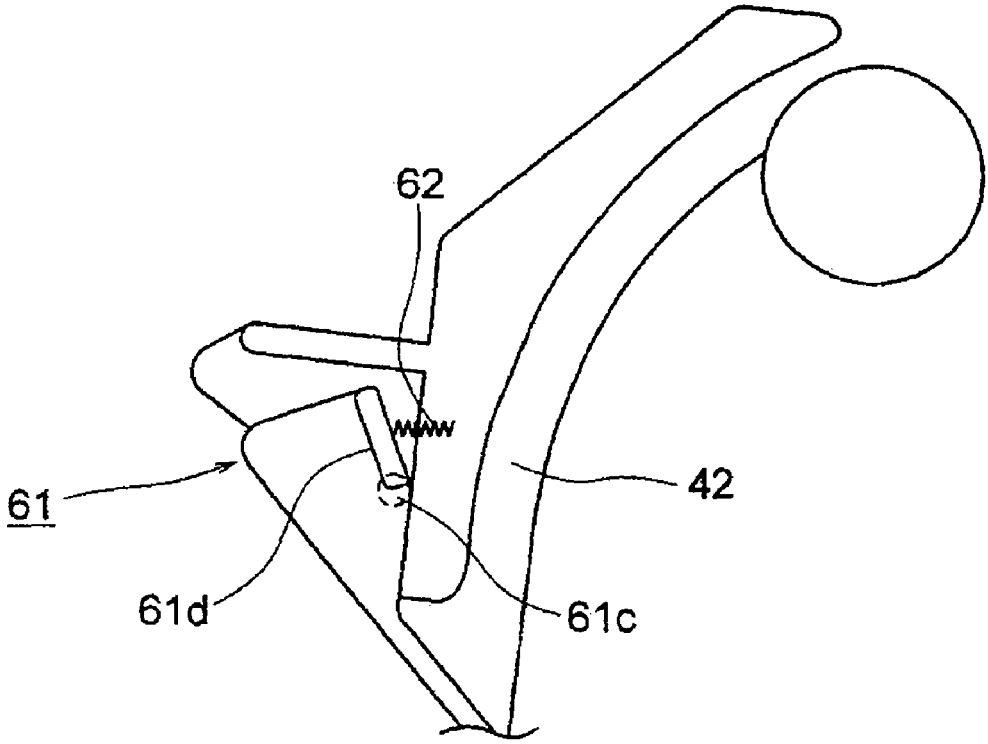
FIG. 19 is a conceptual view showing an essential portion of the face up discharging unit at the time of the face up printing according to the second embodiment of this invention.

At the time of the face up printing, as shown in a FIG. 18, when the face up stacker 52 is set in the opened position, as shown in FIG. 19, the leading guide 61 rotated by an urging force of the coil spring 62 is placed at a position across the face down conveyance route 42, and thus the second surface 61*b* forms the face up conveyance route.

The paper P conveyed by the discharging roller 31L and by the discharging roller 32L is discharged to the face up stacker 52 along the second surface 61*b* of the leading guide 61 without entering into the face down conveyance route 42.

As described above, according to this embodiment, since the leading guide 61 is rotated by an urging force of the coil spring 62, even in a case that stiff paper P such as, e.g., thick paper and a postcard is used, the guiding unit 61 is surely placed at a location across the face down conveyance route 42. Thereby, the face up conveyance route is stably formed with the second surface 61*b*. Furthermore, even in a case that the rotation centers 61*c* become bumpy, the leading guide 61 can be switched stably over a protracted period of time.

Herein, the third embodiment of this invention capable of stably switching whether the face down conveyance route 42 or the face up conveyance route without forming a hole 55 (FIG. 7) for arranging a rotation center will be described. It is to be noted that the substantially same structures as those of the first or the second embodiments are assigned with the same reference numbers respectively, and the advantageous effect of the previous embodiments are applied to the advantageous effects of the embodiment produced because of the substantially same structures as those of the previous embodiments. Since a structure of a printer according to the embodiment of this invention is the same as that according to the first embodiment of this invention, it will described with reference to FIG. 2.

Figure 20:
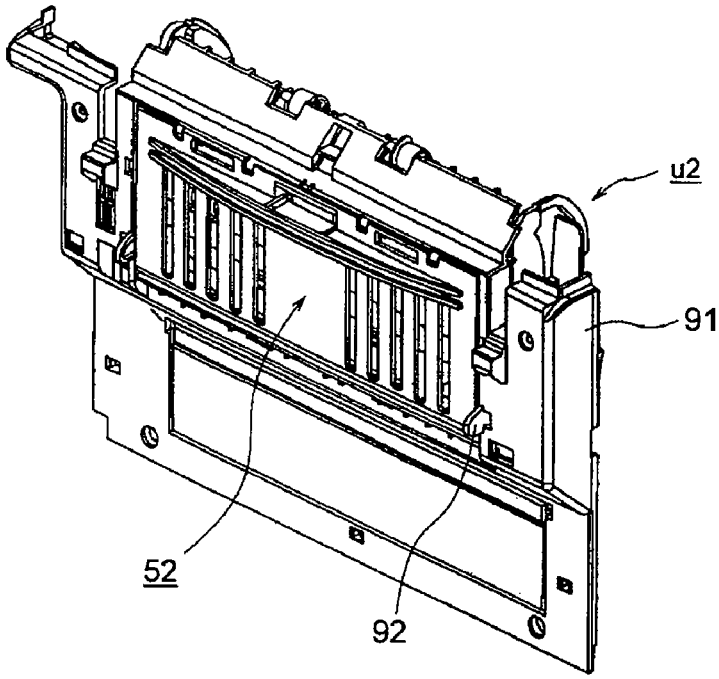
FIG. 20 is a perspective view showing the face up discharging unit according to the third embodiment of this invention.
Figure 21:
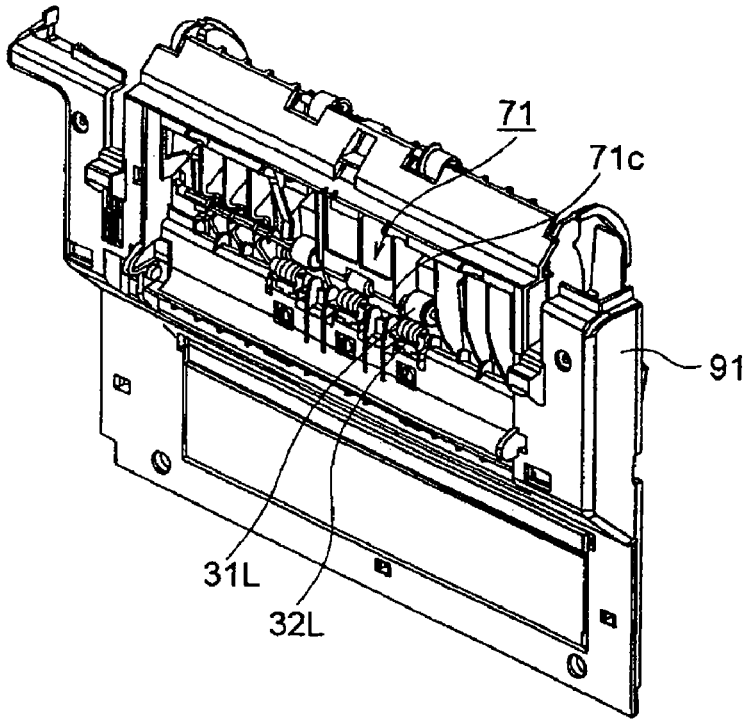
FIG. 21 is a perspective view showing an essential portion of the face up discharging unit according to the third embodiment of this invention.
Figure 22:
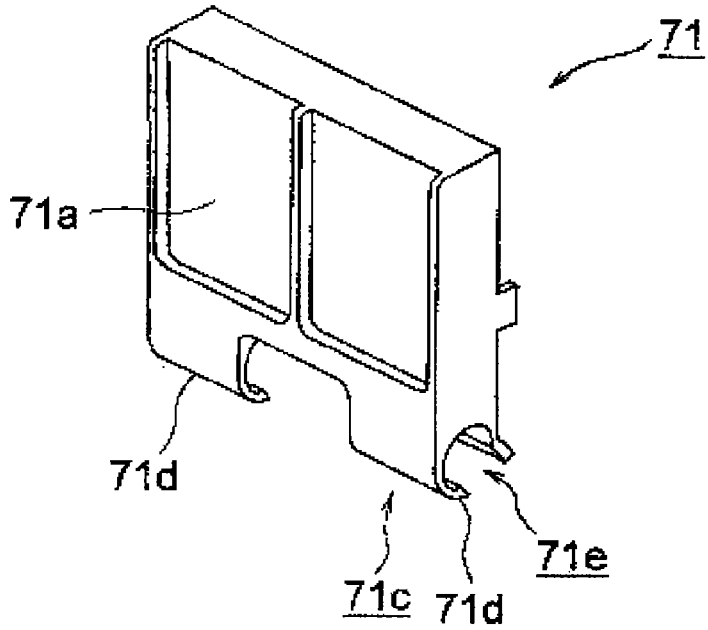
FIG. 22 is a perspective view showing the leading guide according to the third embodiment of this invention.
Figure 23:
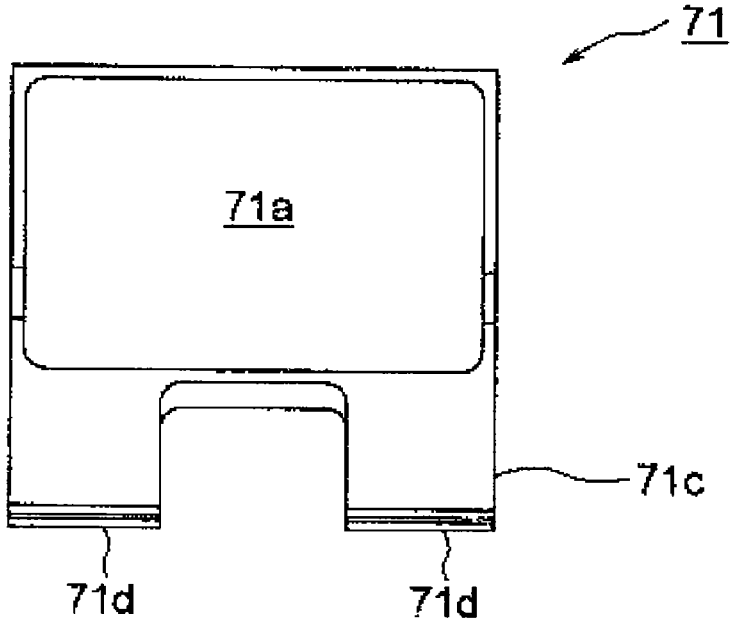
FIG. 23 is a front view showing the leading guide according to the third embodiment of this invention.
Figure 24:
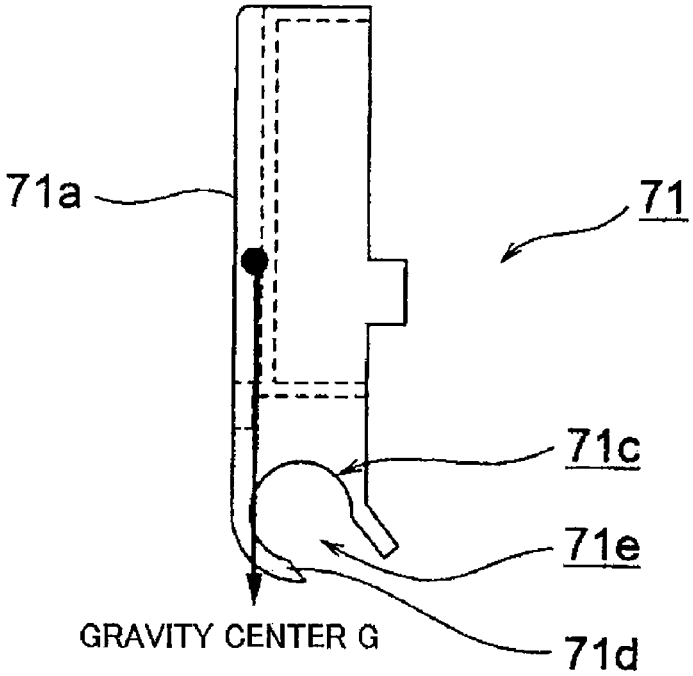
FIG. 24 is a diagram showing a relationship between the gravity center and the rotation center of the leading guide according to the third embodiment of this invention.

FIG. 20 is a perspective view showing the face up discharging unit according to the third embodiment of this invention; FIG. 21 is a perspective view showing an essential portion of the face up discharging unit according to the third embodiment of this invention; FIG. 22 is a perspective view showing the leading guide according to the third embodiment of this invention; FIG. 23 is a front view of the leading guide according to the third embodiment of this invention; FIG. 24 is a diagram showing a relationship between the gravity center and a rotation center of the leading guide; and FIG. 25 is a perspective view showing the face up discharging unit with the leading guide attached at the time of the face up printing according to the third embodiment of this invention.

In the figure, u2 is the face up discharging unit; numeral 91 is the apparatus body of the printer; numeral 71 is a leading guide serving as the guiding member arranged swingably with respect to the apparatus body about a rotation center 71*c* formed at a lower end thereof; numeral 52 is the face up stacker arranged pivotally about the swinging supporting portion 92 formed at a lower end and capable of taking either an opened position and a closed position; and FIG. 21 is showing a state that the face up stacker 52 is removed. The leading guide 71 has a leading surface 71*a* on a side facing the face up stacker 52. It is to be noted that the rotation center 71*c* is arranged coaxially to the discharging roller 31L and arranged in a center of an axis of the discharging roller 31L.

The rotation center 71*c* is formed with a cutout 71*e* which is formed by cutting some portion of the leading guide 71, so that the leading guide 71 can be attached coaxially to the discharging roller 31L. An end portion 71*d* of the cutout 71*e* restricts a rotation angle of the leading guide 71 to a specified amount. It is to be noted that a gravity center G of the leading guide 71 is set at a side of the face up stacker 52 with respect to the rotation center 71*c*.

Figure 25:
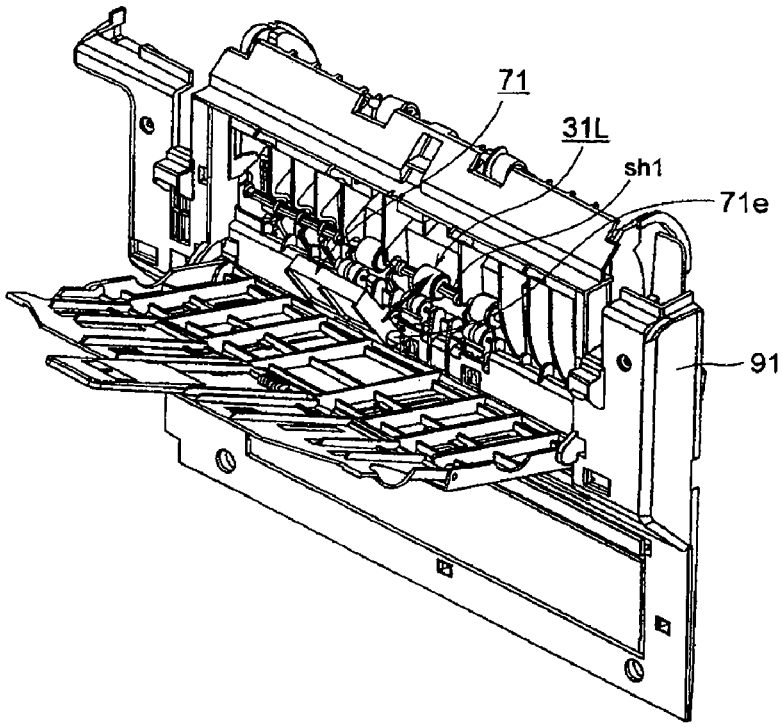
FIG. 25 is a perspective view showing the face up discharging unit to which the leading guide is mounted at the time of the face up printing according to the third embodiment of this invention.

As shown in FIG. 25, the leading guide 71 can be attached by fitting the cutout 71*e* about an axis sh1 of the discharging roller 31L.

Figure 26:
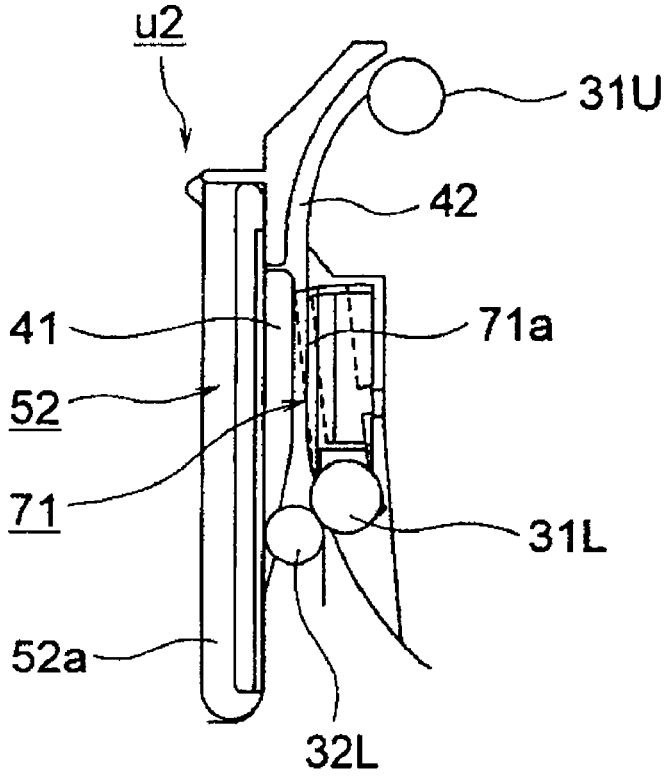
FIG. 26 is a diagram showing the face up discharging unit at the time of the face down printing according to the third embodiment of this invention.
Figure 27:
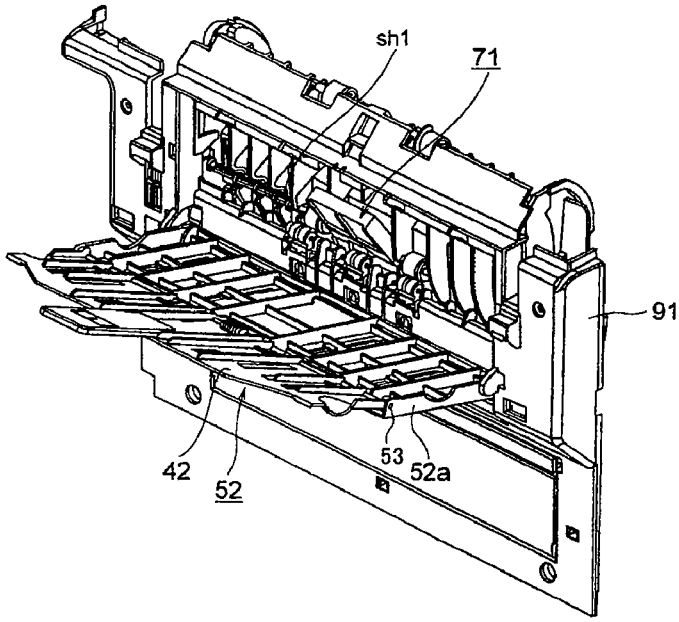
FIG. 27 is a perspective view showing the face up discharging unit at the time of the face up printing according to the third embodiment of this invention.

FIG. 26 is a diagram showing the face up discharging unit at the time of the face down printing according to the third embodiment of this invention; FIG. 27 is a perspective view showing the face up discharging unit at the time of the face up printing according to the third embodiment of this invention; and FIG. 28 is a conceptual view showing the face up discharging unit at the time of the face up printing according to the third embodiment of this invention.

At the time of the face down printing, as shown in FIG. 26, when the face up stacker 52 is set in the closed position, the leading guide 71 falls until coming in contact with the guiding portion 41 and thereby covers the face down conveyance route 42, as indicated by a dashed line.

However, in a state described above, an angle made by a direction of the gravity center G and the face down conveyance route 42 is so small that the leading guide 71 is rotated, as indicated by a full line, as the paper P (FIG. 2) as the medium is conveyed. Thereby, neither a scar, a burr, nor a scratch is occurred at an anterior end of the paper P.

Figure 28:
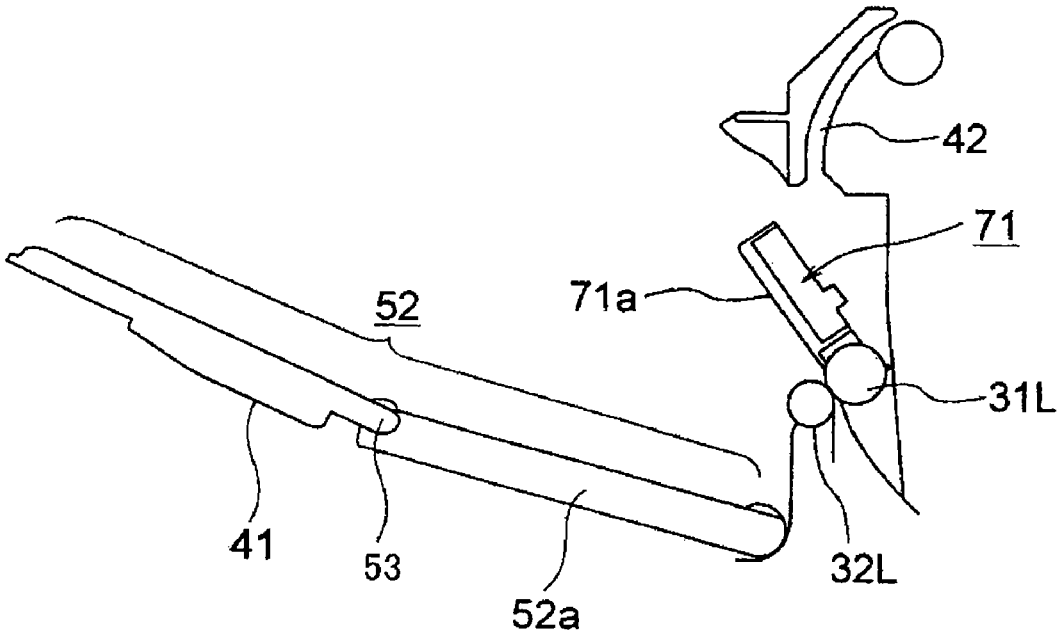
FIG. 28 is a conceptual view showing the face up discharging unit at the time of the face up printing according to the third embodiment of this invention.

In the meantime, at the time of the face up printing, as shown in FIGS. 27 and 28, when the face up stacker 52 is set in the opened position, the leading guide 71 rotated by its own weight about an axis sh1 is placed in a position across the face down conveyance route 42 and stopped at a rotation restriction position. Thereby, the leading surface 71*a* forms the face up conveyance route.

Therefore, according to the embodiment, for example, in a case that large normal curling of the paper P occurs, the paper P is discharged to the face up stacker 52 without being rendered into the face down conveyance route 42. Consequently, no paper jamming occurs, and the paper P is discharged properly.

Furthermore, since the leading guide 71 returns the paper P with the normal curling to its original shape and gives elasticity thereto, the paper P is stacked on the face up stacker 52 in a good condition.

In the meantime, in a case that reverse curling occurs with the paper P, the paper P can be discharged without coming in contact with the leading guide 71, and thereby the reverse curling is not promoted.

Furthermore, since the leading guide 71 can be rotated by its own weight, an urging member and the like are not required. Consequently, a cost for the printer is reduced.

Furthermore, since the hole 55 for arranging the rotation center is not required to be formed, a switching operation between the face down conveyance route 42 and the face up conveyance route is stabilized.

Although the leading guide 71 is rotated automatically when the face up stacker 52 is opened or closed according to the embodiment, an operator can also manually rotate the leading guide 71. Furthermore, a spring as an urging member may urge the leading guide 71 in a rotation direction.

Although the leading guide 71 is arranged at one location according to the embodiment, the leading guides 71 can be arranged at a plurality of locations with spaces among the leading guides 71 being rendered narrower than a minimum width of the paper P.

Although an electrophotographic printer is described in this invention, this invention is applicable to an inkjet printer, thermal printer, a dot impact printer and the like. Although the printer having two discharging units has been described herein, this invention is also applicable to a printer having a plurality of discharging units having a sorting function and to a one having post process functions such as, e.g., a punching function, a scission function, a cutting function, and a binding function and having a plurality of discharging routes.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

an apparatus body;

a first medium stacking unit for stacking medium;

a second medium stacking unit capable of being opened and closed with respect to the apparatus body for stacking the medium;

a guiding member arranged swingably on a non-moving, fixed portion of the apparatus body, the guiding member including a first end at the non-moving, fixed portion of the apparatus body and an opposing free, non-attached second end, an attaching portion proximate the first end having a rotation center serving as a swinging center when attached to the apparatus body;

a first discharging member for conveying the medium to the first medium stacking unit;

a second discharging member for conveying the medium to the first medium stacking unit via the first discharging member and discharging the medium to the second medium stacking unit; and a medium conveyance route formed between the first discharging member and the second discharging member, wherein the guiding member is spaced apart from the first and second discharging members such that when the second medium stacking unit is closed, the medium is guided to the first medium stacking unit by the guiding member in combination with a surface of the second medium stacking unit, and when the second medium stacking unit is open, the medium that is normally curled is guided to the second medium stacking unit by the guiding member and the medium that is other than normally curled is discharged to the second medium stacking unit without contacting the guiding member, wherein the second medium stacking unit includes a first stacking portion and a second stacking portion, the first stacking portion being attached to the second stacking portion in a foldable manner, the second stacking portion being attached to the apparatus body in a foldable manner as the first stacking portion is in a folded state, wherein a rib assisting in conveying the medium to the first medium stacking unit is formed on a surface opposite to a medium stacking surface of the first stacking portion, wherein the guiding member is held in a non-swingable state as sandwiched between the second medium stacking unit and the apparatus body when the second medium stacking unit is in a closed state, and the guiding member is held in a swingable state by the apparatus body when the second medium stacking unit is in an open state, and wherein at least the free, non-attached second end of the guiding member passes over the medium conveyance route when the second medium stacking unit is open, wherein, when the free, non-attached second end of the guiding member passes over the medium conveyance route when the second medium stacking unit is open, the first end of the guiding member is downstream of the free, non-attached second end of the guiding member along the medium conveyance route.

2. The image forming apparatus according to claim 1, wherein the guiding member includes first and second surfaces, and wherein the guiding member guides the medium to the first medium stacking unit with the first surface and guides the medium to the second medium stacking unit with the second surface.

3. The image forming apparatus according to claim 2, wherein when the second medium stacking unit is opened, the guiding member blocks a medium conveyance route to the first medium stacking unit and contacts the medium conveyed to the second surface.

4. The image forming apparatus according to claim 2, wherein when the second medium stacking unit is closed, the guiding member clears a medium conveyance route to the first medium stacking unit and leads the conveyed medium to the first medium stacking unit with the first surface.

5. The image forming apparatus according to claim 1, wherein the guiding member includes a medium guiding portion extended from the attaching portion.

6. The image forming apparatus according to claim 5, wherein the guiding member further includes a stopper preventing the guiding member from swinging when the second medium stacking unit is closed.

7. The image forming apparatus according to claim 5, wherein the guiding member includes a center of gravity arranged with respect to the rotation center of the guiding member to render the attaching portion move toward the second medium stacking unit.

8. The image forming apparatus according to claim 5, wherein the guiding member includes a center of gravity set at a side of the guiding member opposite to the second medium stacking unit with respect to the rotation center.

9. The image forming apparatus according to claim 5, wherein the guiding member includes an urging member urging the attaching portion of the guiding member to a direction of the second medium stacking unit.

10. The image forming apparatus according to claim 1, wherein the guiding member is arranged in a plural number, and wherein at least one of spaces among guiding members is set narrower than a minimum width of the medium to be stacked.

11. The image forming apparatus according to claim 1, wherein the apparatus body includes an image forming unit for forming an image onto the medium and a conveyance member for conveying the medium on which the image is formed to the first or the second medium stacking unit.

12. The image forming apparatus according to claim 11, wherein the first medium stacking unit is arranged at an upper side of the apparatus body, and wherein the second medium stacking unit is formed at a side of the apparatus body.

13. The image forming apparatus according to claim 12, wherein the first medium stacking unit stacks the medium with an image formed side down, and wherein the second medium stacking unit stacks the medium with an image formed side up.

14. The image forming apparatus according to claim 5, wherein the attaching portion pivotally moves around the rotation center of the guiding member in engagement with the second medium stacking unit.

15. The image forming apparatus of claim 5, wherein the medium guiding portion of the guiding member includes a first medium guiding portion and a second medium guiding portion, the second medium guiding portion being arranged in a slant manner with respect to the first medium guiding portion;

wherein the second medium guiding portion guides conveyance of the medium to the first medium stacking unit when the second medium stacking unit is closed, and wherein the first medium guiding portion blocks conveyance of the medium to the first medium stacking unit to the first medium stacking unit when the second medium stacking unit is open.

16. The image forming apparatus according to claim 5, wherein the attaching portion pivotally moves around the rotation center of the guiding member in engagement with a part of the second medium stacking unit.

17. The image forming apparatus according to claim 5, wherein the medium guiding portion of the guiding member includes a first surface and a second surface, the second surface guiding the medium to the first medium stacking unit when the second medium stacking unit is closed, and the first surface blocking a conveyance route to the first medium stacking unit when the second medium stacking unit is opened.

* * * * *